United States Patent [19]

Phoenix et al.

[11] 4,186,713

[45] Feb. 5, 1980

[54] IGNITION SYSTEMS FOR INTERNAL COMBUSTION ENGINE

[75] Inventors: Lancelot Phoenix; Stephen A. Eckhoff, both of Birmingham, England

[73] Assignee: Lucas Industries Limited, Birmingham, England

[21] Appl. No.: 844,947

[22] Filed: Oct. 25, 1977

[30] Foreign Application Priority Data

Oct. 28, 1976 [GB] United Kingdom ..... 44793/76

[51] Int. Cl.[2] ..... H05B 37/02

[52] U.S. Cl. ..... 123/148 E

[58] Field of Search ..... 123/148 E; 315/209 T

[56] References Cited

U.S. PATENT DOCUMENTS

| | | | |
|---|---|---|---|
| 3,020,904 | 2/1962 | Kerr | 315/209 T |
| 3,240,199 | 3/1966 | Neapolitakis | 315/209 T |
| 3,565,048 | 2/1971 | Monpetit | 123/148 E |
| 3,575,154 | 4/1971 | Taylor | 123/148 E |
| 3,605,713 | 9/1971 | Masters et al. | 123/148 E |
| 3,645,246 | 2/1972 | Campbell et al. | 315/209 T |
| 3,821,944 | 7/1974 | Miki et al. | 123/148 E |
| 3,854,466 | 12/1974 | Steinberg et al. | 123/148 E |
| 3,941,112 | 3/1976 | Habert | 123/148 E |
| 4,030,468 | 6/1977 | Sugiura et al. | 123/148 E |
| 4,036,199 | 7/1977 | Chateau | 123/148 E |

*Primary Examiner*—Charles J. Myhre
*Assistant Examiner*—R. A. Nelli
*Attorney, Agent, or Firm*—Ladas, Parry, Von Gehr, Goldsmith & Deschamps

[57] ABSTRACT

An internal combustion ignition system includes a switching transistor, an ignition transformer, a ballast resistor and a current sensing resistor. The primary winding of the transformer, and these two resistors are in series with the collector emitter path of the switching transistor across a supply. A sensing transistor has its base-emitter across the current sensing resistor and its collector connected to control a by-pass transistor with its collector-emitter across the ballast resistor. The transistor is on whenever the current in the sensing resistor is below a set level, thereby allowing a rapid current build up when the switching transistor is switched on.

8 Claims, 4 Drawing Figures

IGNITION SYSTEMS FOR INTERNAL COMBUSTION ENGINE

This invention relates to ignition system for internal combustion engines of the type comprising an ignition transformer having a primary winding connected in series with switch means and a ballast resistor, across a power supply, closing of the switch means effecting initiation of current flow in the primary winding and opening of the switch means interrupting such current flow to create a high voltage spark producing pulse in the secondary winding of the transformer.

In such a system, the ballast resistor and the inductance of the primary winding of the transformer together determine the time constant for the build up of current in the primary winding, the ballast resistor also dissipating power which would otherwise be dissipated in the primary winding. Thus the use of a ballast resistor enable the transformer to be designed with a lower terminal dissipation than would otherwise be necessary.

It is, however, found that, at high speeds, the primary current has insufficient time to build up to a level sufficient to create a high energy spark so that under difficult ignition conditions, misfiring can occur.

It is therefore an object of the invention to provide an ignition system of the kind specified in which a ballast resistor is employed to reduce primary dissipation but in which rapid current build up is possible.

In accordance with the invention there is provided an ignition system of the kind specified in which a further switch means is connected in parallel with the ballast resistor and current sensing means controlling the further switching means so as to open said further switching means whenever the current through the primary winding exceeds a predetermined level.

The further switching means may be a transistor with its collector emitter connected across the ballast resistor and its base voltage controlled by said current sensing means.

The current sensing means may be in the form of a further resistor in series with the ballast resistor and the primary winding and a further transistor with its base-emitter connected across the further resistor and its collector connected to the base of the first-mentioned transistor.

In the accompanying drawings FIGS. 1 to 4 are circuit diagrams of four examples of the invention.

Figure 1:
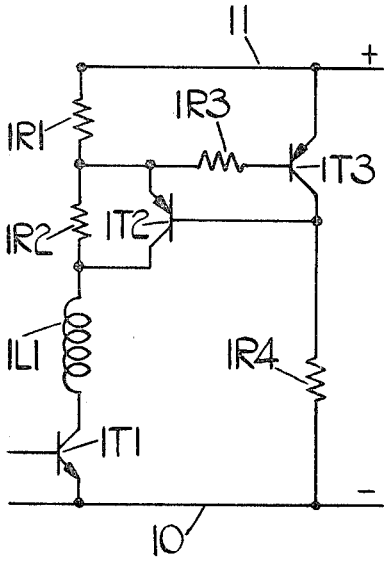

Referring firstly to FIG. 1, the circuit shown includes an output transistor 1T1 of an electronic ignition control circuit (not shown). The emitter of the transistor 1T1 is connected to an earth rail 10 and its collector is connected by the primary winding 1L1 of an ignition transformer to one end of a ballast resistor 1R2, the other end of which is connected by a current sensing resistor 1R1 to a positive supply rail 11. The junction of the resistors 1R1 and 1R2 is connected to the emitter of a pnp power transistor 1T2, the collector of which is connected to the junction of the resistor 1R2 with the winding 1L1. The base of transistor 1T2 is connected by a resistor 1R4 to the rail 10 so that the transistor 1T2 is biased hard on, shunting the resistor 1R2.

The current sensing resistor 1R1 controls the conduction of a third transistor 1T3 which is a pnp transistor with its emitter connected to the rail 11 its base connected by a resistor 1R3 to the emitter of the transistor 1T2 and its collector connected to the base of the transistor 1T2.

When the transistor 1T1 is off and there is no current flowing in the primary winding 1L1, the transistor 1T3 will be off and base current for the transistor 1T2 will flow through the resistors 1R1 and 1R4 turning this transistor on to shunt the ballast resistor 1R2. When the transistor 1T1 turns on, therefore, the time constant for current build up in the primary winding 1L1 is set by the inductance of the winding 1L1 and the comparatively small resistance of the resistor 1R1 (plus the resistance of the winding 1L1).

When the current in the winding 1L1 and the resistor 1R1 reaches a predetermined level the transistor 1T3 switches on, switching off the transistor 1T2 and putting the resistor 1R2 in series with the resistor 1R1 to limit the maximum current through the winding 1L1. The value of the resistor 1R1 is chosen in relation to the base-emitter voltage of the transistor 1T3 so that the transistor 1T3 starts the conduct at a current level somewhat less than the maximum current which can flow through the series combination of the resistors 1R1, 1R2, the winding 1L1 and the collector-emitter path of the transistor 1T1. Thus, for example, if the maximum current is 6 amps, the resistor 1R1 is chosen to cause the transistor 1T3 to turn on at about 5 amps. With this arrangement switching off of the transistor 1T2 does not cause a reduction in the current, but merely a decrease in the rate of increase of the current. Choice of the resistor 1R1 to cause switching on of the transistor 1T3 at a current equal to or greater than the maximum "normal" current would result in the arrangement operating as a feedback amplifier acting as a controlled current source with considerable power being dissipated from the transistor 1T2. Choice of the resistor 1R1 to give the preferred-current level for switching ensures that the transistors operate as switches with minimum power dissipation.

Figure 2:
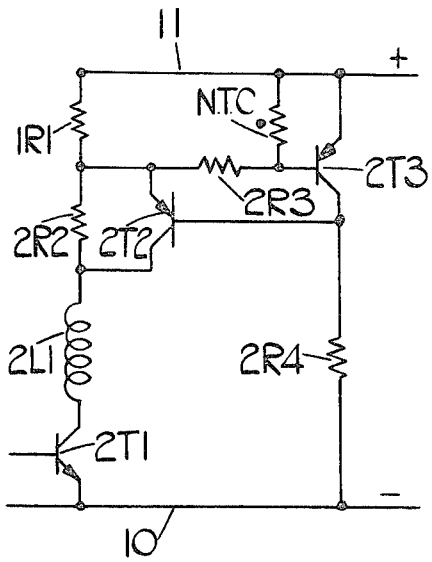

FIG. 2 shows a modification of the circuit of FIG. 1, in which a negative temperature coefficient thermistor NTC is connected between the base and emitter of the transistor 2T3. Such an arrangement is intended to compensate for the variation of the forward breakdown voltage Vbe of the base-emitter of the transistor 2T3 with temperature, i.e. as the temperature rises and Vbe falls the proportion of the voltage on the resistor 2R1 which is applied to the base-emitter of transistor 2T3 also falls.

Figure 3:
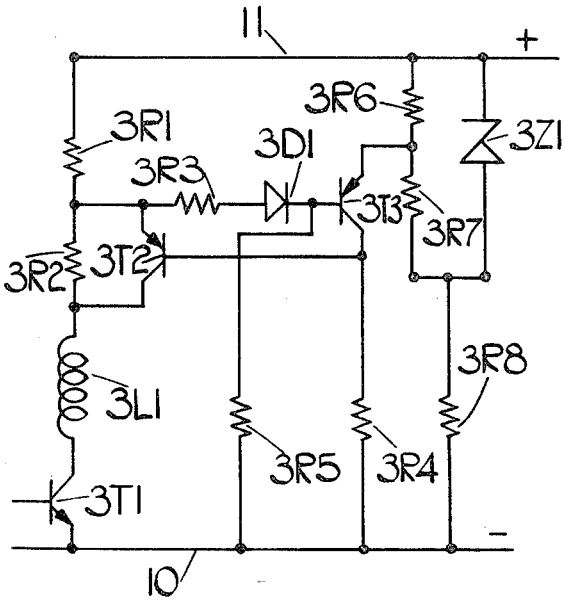

Turning now to FIG. 3 the circuit shown is again intended to provide compensation for temperature fluctuations. In this case a diode 3D1 is interposed between the resistor 3R3 (corresponding to the resistor 1R3) and the base of the transistor 3T3 and a resistor 3R5 is connected between the base of the transistor 3T3 and the earth rail 10. The emitter of the transistor 3T3 is not connected directly to the rail 11, but is instead connected to the common point of a pair of resistors 3R6, 3R7 connected in series across a zener diode 3Z1 which is in series with a resistor 3R8 across the terminals 10, 11. When the transistor 3T3 is off, the voltage across the resistor 3R6 is a fixed proportion of the zener breakdown voltage of the zener diode 3Z1. This diode is chosen to have a temperature coefficient close to zero (e.g. a 5.6 V zener diode operating at a current of about 6 MA). The diode 3D1 provides temperature compensation for the base-emitter junction of the transistor 3T3 so that the transistor switches on at a current through the resistor 3R1 such that the voltage at the junction of resistors 3R1 and 3R2 is equal to the voltage at the junction of the resistors 3R6 and 3R7 which is substantially independent of temperature.

Figure 4:
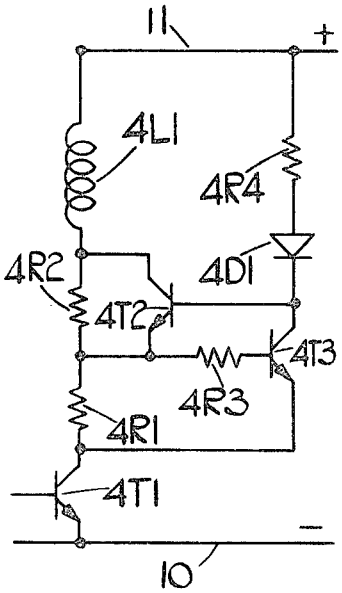

Turning finally to FIG. 4, the circuit shown is similar to that in FIG. 1 but uses only npn transistors. In this case the order of the primary winding 4L1, the ballast resistor 4R2 and the current sensing resistor 4R1 is reversed and the emitter of the transistor 4T3 is connected to the collector of the transistor 4T1. In addition a forwardly biased diode is included in series with the resistor 4R4 between the rail 10 and the collector of the transistor 4T3. The diode 4D1 protects the transistor 4T2 against the reverse voltage surge which occurs in the winding 4L1 when the transistor 4T1 switches off.

In every case the ignition transformer has a secondary winding (not shown) in which a high voltage is induced when the transistor 1T1, 2T1, 3T1 or 4T1 is switched off following build up of current in the primary winding 1L1, 2L1, 3L1 or 4L1.

We claim:

1. An ignition system for an internal combustion engine comprising an output transistor having its emitter connected to one of a pair of supply conductors, an ignition transformer having a primary winding which has one end connected to the collector of said switching transistor, a ballast resistor and a current sensing resistor connected in series between the other end of the primary winding and the other of said supply conductors, a ballast by-pass transistor, of opposite conductivity type from the output transistor, having its emitter connected to the junction of the ballast resistor and the current sensing resistor, and its collector connected to said other end of the primary winding, a sensing transistor of the same conductivity type as said by-pass transistor and having its emitter connected to said other supply conductor, its base connectd to the junction of the ballast resistor and the current sensing resistor and its collector connected to the base of the by-pass transistor and a bias resistor connecting the base of said by-pass transistor to said one supply conductor, whereby when the current in the current sensing resistor is below a predetermined value, which is below the steady state current which can flow from the power supply through the series combination of the current sensing resistor, the ballast resistor and the primary winding, the by-pass transistor short-circuits the ballast resistor, whereas when the current reaches the predetermined value the by-pass transistor is switched off but the current in the current sensing resistor continues to increase, current flow in the primary winding being initiated by switching on of the output transistor and switching off of the output transistor causing interruption of such current flow to create a high voltage spark producing pulse in the transformer secondary winding.

2. A system as claimed in claim 1 further comprising a resistor connected between the junction of said ballast resistor with said current sensing resistor and the base of the sensing transistor.

3. A system as claimed in claim 2 further comprising a thermistor connected across the base-emitter of the sensing transistor.

4. A system as claimed in claim 1, further comprising a first resistor and a diode in the connection between the junction of the ballast resistor with the current sensing resistor and the base of the sensing transistor, a second resistor connecting the base of said sensing transistor to said one supply conductor, and means for applying a bias voltage to the emitter of the sensing transistor.

5. A system as claimed in claim 4 in which said means for applying a bias voltage comprises a zener diode and a third resistor connected in series between the supply conductors, and fourth and fifth resistors connected in series across the zener diode, the emitter of the sensing transistor being connected to the junction of said fourth and fifth resistors.

6. An ignition system for an internal combustion engine comprising:

an ignition transformer having a primary winding;

first switch means, a ballast resistor and a current sensing resistor in series with said primary winding across a power supply, closing of said first switch means effecting initiation of current flow in the primary winding and opening of said first switch means interrupting such current flow to create a high voltage spark producing pulse in the transformer secondary winding;

further switch means connected in parallel with the ballast resistor; and voltage sensitive means connected to control said further switch means and responsive to the voltage across said current sensing resistor reaching a predetermined level to operate the further switch means to an open condition, the resistance of the current sensing resistor being such in relation to the resistance of the ballast resistor that the voltage across the current sensing resistor reaches said predetermined level at a current value less than the steady state current which can flow from the power supply through the current sensing resistor, the ballast resistor and the primary winding, whereby upon the further switch means being operated to an open condition the current through the primary winding continues to increase.

7. A system as claimed in claim 6 in which said further switch means is a transistor with its collector-emitter connected across the ballast resistor and its base voltage controlled by said voltage sensitive means.

8. A system as claimed in claim 7 in which said voltage sensitive means comprises a further transistor with its base-emitter connected across the current sensing resistor and its collector connected to the base of said first-mentioned transistor.

* * * * *